US011498066B2

(12) United States Patent
Graham et al.

(10) Patent No.: US 11,498,066 B2
(45) Date of Patent: Nov. 15, 2022

(54) NON-CONTACT LIQUID PRINTING

(71) Applicant: The Technology Partnership Plc, Royston (GB)

(72) Inventors: Abi Graham, Cambridge (GB); Sam Pollock, Hitchin (GB); Sam Hyde, Fen Ditton (GB)

(73) Assignee: The Technology Partnership Plc

( * ) Notice: Subject to any disclaimer, the term of this patent is extended or adjusted under 35 U.S.C. 154(b) by 1007 days.

(21) Appl. No.: 16/309,568

(22) Filed: Dec. 13, 2018

(65) Prior Publication Data

US 2019/0248137 A1 Aug. 15, 2019

Related U.S. Application Data

(63) Continuation of application No. 15/526,479, filed as application No. PCT/GB2015/053389 on Nov. 9, 2015, now Pat. No. 10,183,489.

(30) Foreign Application Priority Data

Nov. 14, 2014 (GB) ..... 1420264

(51) Int. Cl.

| | |
|---|---|
| ***B01L 3/02*** | (2006.01) |
| ***B41J 2/14*** | (2006.01) |
| *B01L 3/00* | (2006.01) |

(52) U.S. Cl.

CPC ..... *B01L 3/0268* (2013.01); *B01L 3/0241* (2013.01); *B41J 2/1433* (2013.01); *B41J 2/14201* (2013.01); *B41J 2/14427* (2013.01); *B01L 3/00* (2013.01); *B01L 3/02* (2013.01); *B41J 2002/14475* (2013.01); *B41J 2202/15* (2013.01)

(58) Field of Classification Search

CPC ..... B01L 3/0268; B01L 3/0241

See application file for complete search history.

(56) References Cited

U.S. PATENT DOCUMENTS

| | | | | |
|---|---|---|---|---|
| 4,246,076 | A | 1/1981 | Gardner | |
| 5,451,993 | A | 9/1995 | Takahashi et al. | |
| 6,086,196 | A | 7/2000 | Ando et al. | |
| 6,089,700 | A | 7/2000 | Ahn | |
| 6,290,331 | B1 | 9/2001 | Agarwal et al. | |
| 2004/0082076 | A1* | 4/2004 | Zengerle | B41J 2/04 436/180 |

(Continued)

FOREIGN PATENT DOCUMENTS

| | | |
|---|---|---|
| EP | 0047609 A2 | 3/1982 |
| EP | 0600712 A2 | 6/1994 |

(Continued)

OTHER PUBLICATIONS

International Search Report for PCT/GB2015/053389 dated May 2, 2016.

*Primary Examiner* — Sharon Polk

(74) *Attorney, Agent, or Firm* — Lerner, David, Littenberg, Krumholz & Mentlik, LLP

(57) ABSTRACT

A perforate element for use in a print head for non-contact liquid printing comprises: at least one ejection element including an outlet, configured to eject a bulk flow of printing liquid out of the print head; and a liquid residence element, arranged to provide a layer of liquid over the outlet which extends laterally of the outlet and through which the bulk flow is ejected.

20 Claims, 3 Drawing Sheets

(56) References Cited

U.S. PATENT DOCUMENTS

| | | | |
|---|---|---|---|
| 2004/0174411 | A1 | 9/2004 | Sumiya et al. |
| 2007/0290068 | A1 | 12/2007 | Lu |
| 2012/0113197 | A1 | 5/2012 | Kashu et al. |

FOREIGN PATENT DOCUMENTS

| | | | |
|---|---|---|---|
| JP | 2000309104 | A | 11/2000 |
| JP | 2006035536 | A | 2/2006 |
| WO | 9310910 | A1 | 6/1993 |
| WO | 2005065330 | A2 | 7/2005 |
| WO | 2007149235 | A1 | 12/2007 |

* cited by examiner

NON-CONTACT LIQUID PRINTING

CROSS-REFERENCE TO RELATED APPLICATIONS

The present application is a continuation of U.S. application Ser. No. 15/526,479, filed May 12, 2017, which is a national phase entry under 35 U.S.C. § 371 of International Application No. PCT/GB2015/053389 filed Nov. 9, 2015, published as WO 2016/075447, which claims priority from Great Britain Patent Application No. 1420264.2, filed Nov. 14, 2014, the disclosures of which are incorporated herein by reference.

BACKGROUND OF THE INVENTION

The present invention relates to non-contact printing, in particular to a perforate element for use in a print head for non-contact liquid printing.

BRIEF SUMMARY OF THE INVENTION

Diagnostic testing of biological samples can be performed efficiently using multiplexed assays whereby multiple reagents may be printed in an array on a test substrate and subsequently exposed to a test sample for analysis. If it were possible to print reagents containing cells then the range of tests that may be performed could be significantly extended.

Referring to FIGS. 1*a* and 1*b*, a known non-contact printing apparatus 1, for example of the type described in WO-93/10910, comprises a fluid source 3 from which fluid is brought by capillary feed 5 to the rear face 9*a* of a perforate membrane 9 comprising a plurality of nozzles 11. A vibration means or actuator 13 is operable by an electronic circuit 15 which derives electrical power from a power supply 17 to vibrate the perforate membrane 9, producing droplets of fluid 19 from the front face 9*b* of the perforate membrane 9. The actuator 13 comprises a piezoelectric and/or electrostrictive actuator, or a piezomagnetic or magnetostrictive actuator in combination with an electrical or magnetic field applied within at least part of the actuator material alternating at a selected frequency. The actuator 13 may be formed as an element responsive by bending to an applied field. These forms of actuator can provide relatively large amplitudes of vibrational motion for a given size of actuator in response to a given applied alternating field. This relatively large motion may be transmitted through means bonding together regions of the actuator 13 and the perforate membrane 9 to provide correspondingly relatively large amplitudes of vibratory motion of the perforate membrane 9, so enhancing droplet dispensation.

Liquid reagents which contain biological cells present significant challenges for non-contact printers such as this, since the presence of these cells, particularly in the region of the printing nozzles, creates non-uniformities in liquid flow and behaviour which are difficult to predict. Additional challenges relate to the viability of the cells and the likelihood of these cells remaining undamaged during the printing process.

To achieve reliable assay results the reagent printing requirements will typically include a specific spot size and size uniformity within an array, good spot placement accuracy, high print reliability including low instances of print failures and low instances of additional satellite spots, and low rates of cell damage. The presence of cells in the printing liquid compromises the ability of traditional printing technologies to achieve this performance.

Non-contact printing technologies require ejection of liquid through nozzles and when cells are introduced this presents two challenges: firstly the risk that the nozzles will become blocked, either partially or completely, by the cells, and secondly the damage that the cells may experience during ejection. Blockage is a very common problem with all traditional non-contact printing technologies. Mechanisms for cell damage can result from the shear stresses that are present in liquid near to the ejection region, or alternatively from thermal effects (e.g. bubble jet technologies). Consequently print reliability and cell viability are difficult to achieve.

An alternative printing approach, typically applied in low speed printing, is that of contact printing, typically using specially constructed pins. This avoids issues with nozzles and generally allows for good cell viability. However it does require precise control of the alignment and movement of the printing pins relative to the printed substrate and also requires periodic replenishment of the pins. These processes are slow and consequently are not considered viable for low cost high throughput manufacturing of arrays.

Accordingly, it would be beneficial to establish a non-contact printing technology for liquids containing cells which offers improvements with respect to, for example, print stability and reliability.

The invention is set out in the accompanying claims.

According to an aspect of the invention, there is provided a perforate element for use in a print head for non-contact liquid printing, the perforate element comprising: at least one ejection element including an outlet, configured to eject a bulk flow of printing liquid out of the print head; and a liquid residence element, arranged to provide a layer of liquid over the outlet which extends laterally of the outlet and through which the bulk flow is ejected.

Investigation has shown that when printing a "difficult" fluid, such as a suspension of cells, "Drop-on-Demand" printing is very unstable if using a nozzle in the conventional way. The cells/particles cause variability in the velocity and direction of ejected droplets, which then leads to splashing on one side of the nozzle—this then pulls the droplet ejection off to one side and produces a poorly-formed droplet-stream at an angle, or absolute failure to eject because fluid then floods the exterior of the perforate element, or nozzle plate. Because the cell suspensions contain various hydrophilic molecules (e.g. proteins), once the liquid has wetted the area around the outside of the nozzle, the liquid meniscus does not retract back to the edges of the nozzle because the nozzle plate surface becomes hydrophilic thereafter. Irreversible print failure therefore occurs in a short time.

It has been found that if, instead, a small controlled pool of liquid is produced on the exterior of the nozzle, this then puts the liquid meniscus some lateral distance away from the actual nozzle where droplet generation is occurring. Accordingly, any irregularities in this meniscus exert very little force on the droplet formation process, enabling much more stable operation. In addition, pressure fluctuations from the nozzle have little effect on the position of this meniscus because it is away from the nozzle where pressure fluctuations are much lower, so the meniscus is also less likely to become irregular in the first place. Also, splashing events near the nozzle simply land back into the controlled pool of liquid, having no effect on subsequent droplet ejection.

Thus, the invention provides a liquid residence element, and thereby a layer of liquid extending over the outlet and laterally of the outlet, so that the main flow of the printing liquid may pass through the liquid layer, with the effect that ejection of the printing liquid is made more uniform and stable, leading to improved print stability and reliability.

Appropriate printing liquids include, but are not limited to, reagents which may include DNA, proteins, antibodies, cells and cell fragments, and other materials including suspensions.

The layer of liquid may comprise printing liquid which is similar in type to the printing liquid of the bulk flow. Alternatively, the layer of liquid may comprise a liquid which is different in type to the printing liquid of the bulk flow.

A priming liquid, different to the printing liquid, for example glycerol, may be used to prime the printing head prior to commencement of printing operations. Priming the print head is advantageous because it can prevent disturbance of the bulk flow as it emerges from the outlet. The priming liquid may be applied to the liquid residence element from the print head reservoir via the nozzle, for example using a priming waveform, or can be deposited directly on the liquid residence element, without passing through the nozzle. Once printing operations are underway, the priming liquid will tend to be partially or fully replaced by the printing liquid at the liquid residence element, in a controlled manner, such that the layer of liquid at the outlet is comprised entirely, or almost entirely, of the printing liquid.

The mechanism by which the priming waveforms work is not completely understood, but it is thought that surface waves of the nozzle plate help to un-pin the liquid from the nozzle edges, possibly by creating a range of contact angles between surface and liquid meniscus, with pressure fluctuations then pushing the liquid further and further across the nozzle plate to provide the layer of liquid extending laterally of the nozzle outlet.

The liquid residence element may be distal from the outlet with respect to the direction of the bulk flow. Alternatively, the liquid residence element may be adjacent the outlet, optionally immediately adjacent.

The liquid residence element may comprise a liquid retention element which is configured to retain or hold the layer of liquid. The liquid residence element may comprise a recess in a surface of the perforate element, for retaining or holding the layer of liquid. The effect of the layer of liquid on the bulk flow may be enhanced if the layer of liquid is retained, or "pinned", to the liquid residence element, in a controlled manner. One means of retaining the liquid is to provide the liquid residence element in the form of a recess in the perforate element, or nozzle plate, the sides of the recess preventing the layer of liquid from easily detaching from the nozzle plate. For example, the recess may be arranged in the nozzle plate to comprise a shallow, cylindrical bore which encircles or surrounds the outlet. The same benefit may be obtained by the provision of a raised element, for example a projection having a circular wall extending from the nozzle plate at some lateral distance from the outlet, which can capture the layer of liquid around the outlet. Alternatively, a trench may be provided in the perforate element and extend some lateral distance from the outlet.

The recess may have a ratio of lateral width to depth of between about 1 and 100. The recess may have a ratio of lateral width to depth of about 8. The recess may have depth of about 3 to 50 microns. The recess may have depth of about 25 microns. The recess may have a lateral width of about 40 to 2,000 microns. The recess may have a lateral width of about 200 microns. The recess may extend laterally of the outlet by about 15 to 920 microns. The recess may extend laterally of the outlet by about 40 microns. The ratio of the lateral width of the recess to the lateral width of the outlet may be about 1.7. The outlet may have a diameter or lateral width of about 10 to 160 microns. The outlet may have a diameter or lateral width of about 120 microns.

If the recess is made shallow, relatively low voltages are required to eject droplets, but the recess is more prone to accidental overflowing. Conversely, if the recess is deeper, it is more resistant to overflowing, but requires larger voltages to eject a droplet. The optimum depth of recess will probably depend on the stability of the particular liquid within the recess. Relevant factors include surface tension/contact angle on the nozzle and material/viscosity. A lower surface tension liquid may be more liable to spill over, requiring a deeper recess combined with whatever voltages are acceptable for droplet ejection. Acceptable voltages will depend on the maximum voltages the print head can withstand, and the voltages which can be supplied by the print head drive electronics. A recess depth of about 25 microns appears to provide acceptable performance for the current reagents. A recess depth of about 4 microns has been found to be significantly less stable. A wider recess appears to be more stable to accidental overflow, but is harder to prime in the first place. A recess width of about 200 microns appears to provide acceptable performance for the current reagents. Recess width and depth may also influence drop size (droplets may be larger for wider, deeper recesses).

In addition to the recess, or instead, the liquid residence element may comprise an hydrophilic and/or an hydrophobic element, for retaining the layer of liquid. For example, this may comprise an hydrophobic material or coating on a portion of the perforate element, possibly in conjunction with an hydrophilic material or coating around the area of the outlet, which will have the effect of attracting and controlling the layer of liquid in the vicinity of the outlet.

The at least one ejection element may comprise a nozzle. The nozzle may be a generally convergent nozzle. Or, the nozzle may be a generally divergent nozzle. Or, the nozzle may be a convergent-divergent nozzle. The liquid residence element may comprise a portion of the nozzle.

The perforate element, or nozzle plate, may comprise a plurality of ejection elements, or nozzles, and respective liquid residence elements.

As has been described herein above, examples of the liquid residence element, which provides the layer of liquid at or over the nozzle through which the bulk flow may be ejected, include a recess, a hydrophilic element, a hydrophobic element, or any combination of these. It will be apparent to the skilled reader that the liquid residence element could take various other forms which achieve the effect of providing a layer or volume of liquid at the nozzle outlet, and all of these are within the scope of the claimed invention. Furthermore, while the exemplary recess and hydrophilic/hydrophobic elements tend to retain positively or actively the layer of liquid to the nozzle plate (i.e. respectively by containment and attractive/repulsive forces), such that the liquid residence element may be thought of as a liquid retention element, it will be understood that the liquid layer may also be provided by, say, a passive liquid residence element, which is not specifically configured to hold or attract the layer of liquid to the nozzle plate. For instance, the recess may be omitted and, instead, a passive, external surface of the nozzle plate may be provided with a layer of liquid, for example a pool or a continuous flow, at or over the nozzle outlet, the bulk flow of the printing liquid being driven through this flowing liquid to eject the droplets from the nozzle plate.

According to another aspect of the invention, there is provided a print head for a non-contact liquid printer, including a perforate element as described herein above. The print head may include at least one piezoelectric bending mode actuator for vibrating the ejection element or elements.

BRIEF DESCRIPTION OF THE DRAWINGS

Embodiments will now be described, by way of example, with reference to the accompanying figures in which.

DETAILED DESCRIPTION

Figure 1A:
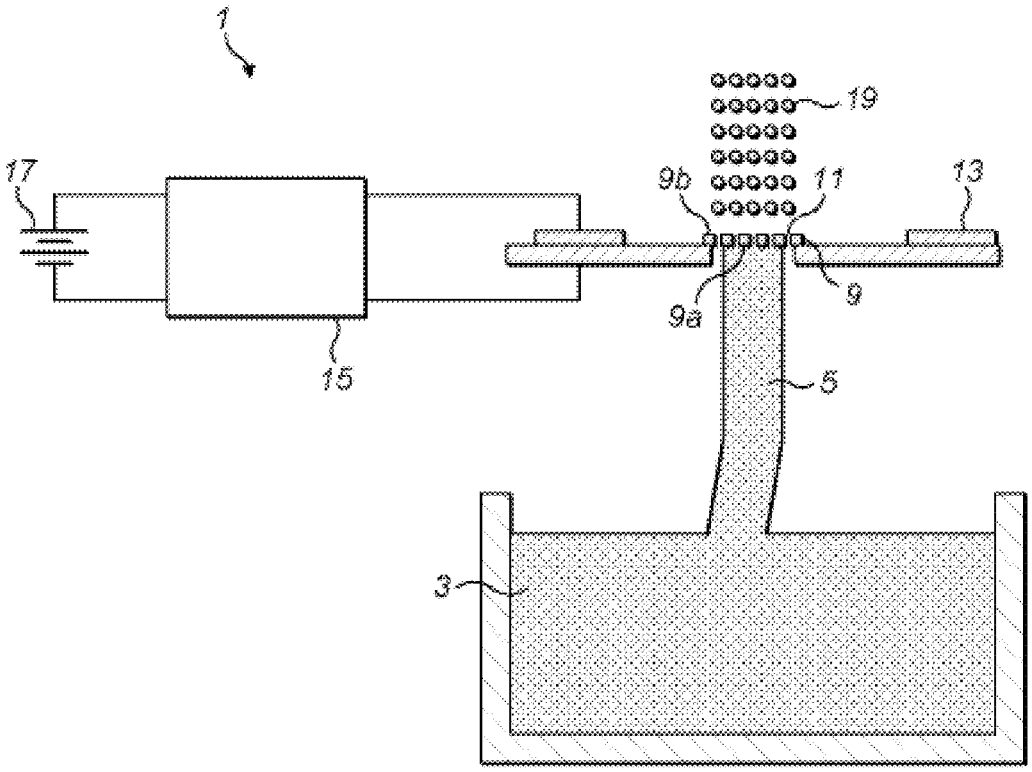
FIGS. 1*a* and 1*b* are schematic depictions of a known, non-contact printing apparatus.
Figure 1B:
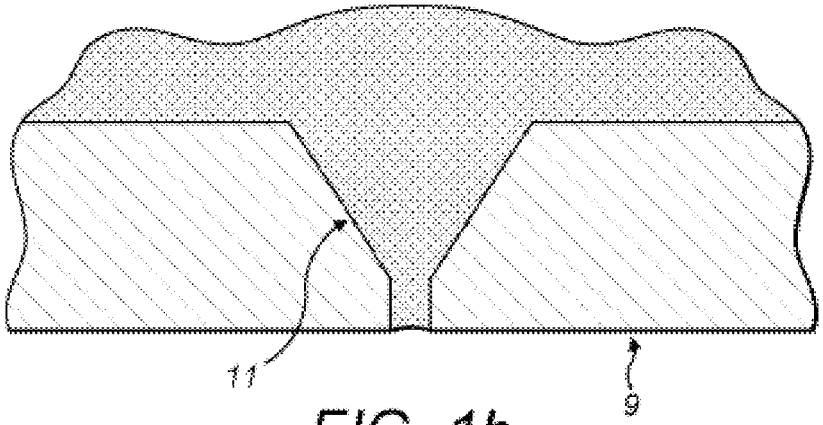
Figure 2A:
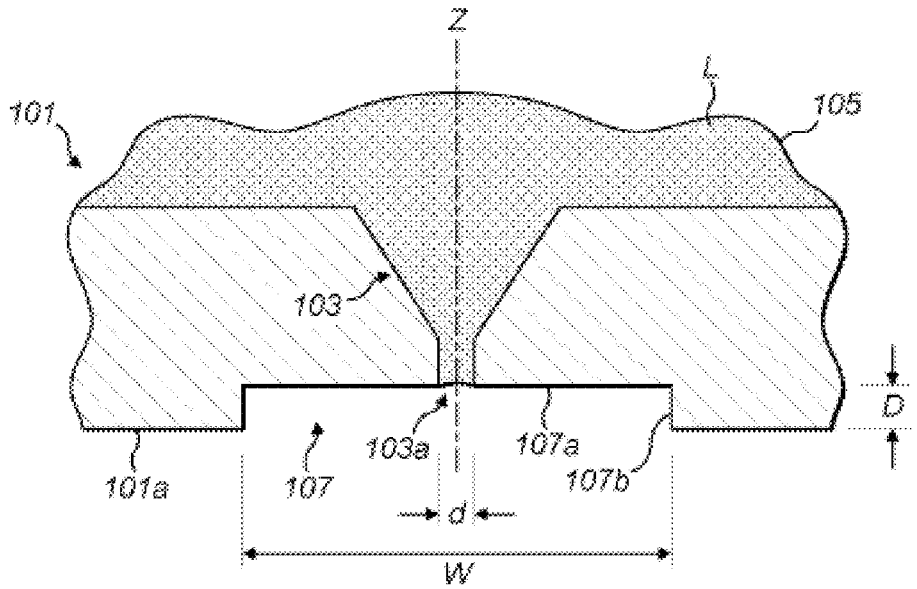
FIGS. 2*a* and 2*b* are schematic depictions showing respective sectional- and plan-views of a portion of a perforate element for a non-contact printer, in accordance with an embodiment of the invention.
Figure 2B:
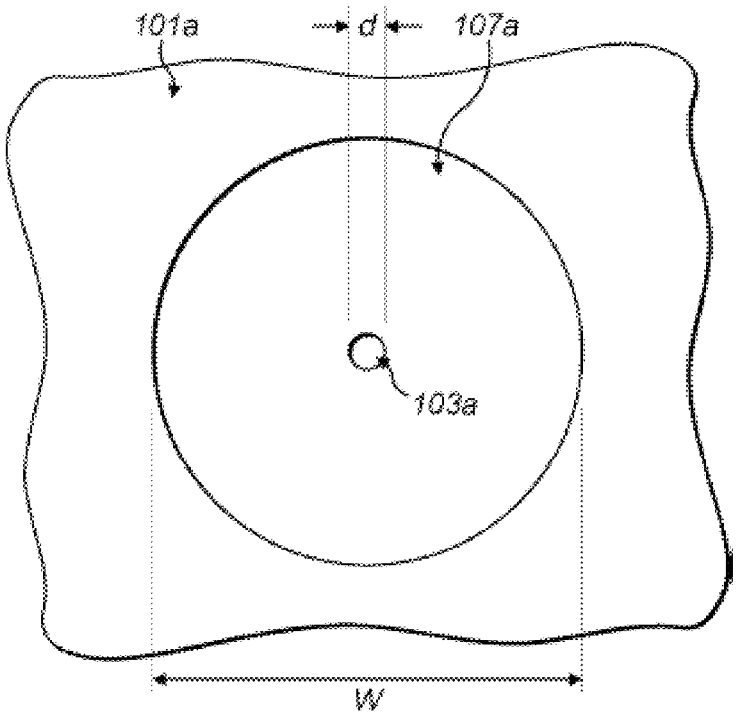

Referring to FIGS. 2*a* and 2*b*, a perforate element, or membrane, or nozzle plate 101, for a non-contact liquid printer, for example of the type shown in FIGS. 1*a* and 1*b*, comprises a plurality of ejection elements, or nozzles 103 (only one of which is shown), each comprising an outlet 103*a*. In this exemplary embodiment, the nozzle 103 is a generally convergent-type nozzle 103 having a longitudinal axis Z, and is in fluid communication with a liquid reservoir 105, which is arranged to feed all of the nozzles with a printing liquid L, in this embodiment a reagent including biological cells.

Also in this embodiment, a liquid residence element comprises a shallow, circular recess 107 which is formed in an external surface 101*a* of the nozzle plate 101 around the nozzle outlet 103*a*. The recess 107 includes a generally flat base portion 107*a*, which extends laterally of the outlet 103*a*, in a plane substantially normal to the longitudinal axis Z of the nozzle 103, and a peripheral shoulder portion 107*b*, which extends between the base portion 107*a* and the external surface 101*a* of the nozzle plate 101, in the direction of the longitudinal axis Z. In this exemplary embodiment, the outlet 103*a* has a lateral width, or diameter d, of about 120 microns, while the recess 107 has a depth D of about 25 microns and a diameter, or lateral width W, of about 200 microns. Accordingly, in this embodiment, the lateral distance between the edge of the outlet 103*a* and the shoulder portion 107*b* is about 40 microns.

Referring in particular to FIG. 2*b*, in this embodiment, a region of the external surface 101*a* of the nozzle plate 101 comprises a hydrophobic coating, which tends to repel the printing liquid L, and the base and shoulder portions 107*a*, 107*b* of the recess 107 comprise a hydrophilic coating, which tends to attract the printing liquid L.

Figure 3A:
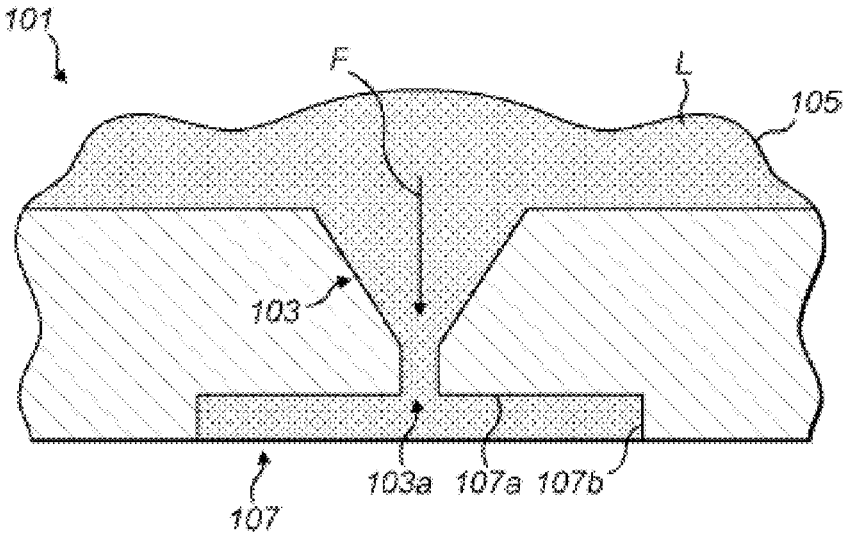
FIGS. 3*a* and 3*b* show the portion of the perforate element of FIGS. 2*a* and 2*b* in an operative condition.
Figure 3B:
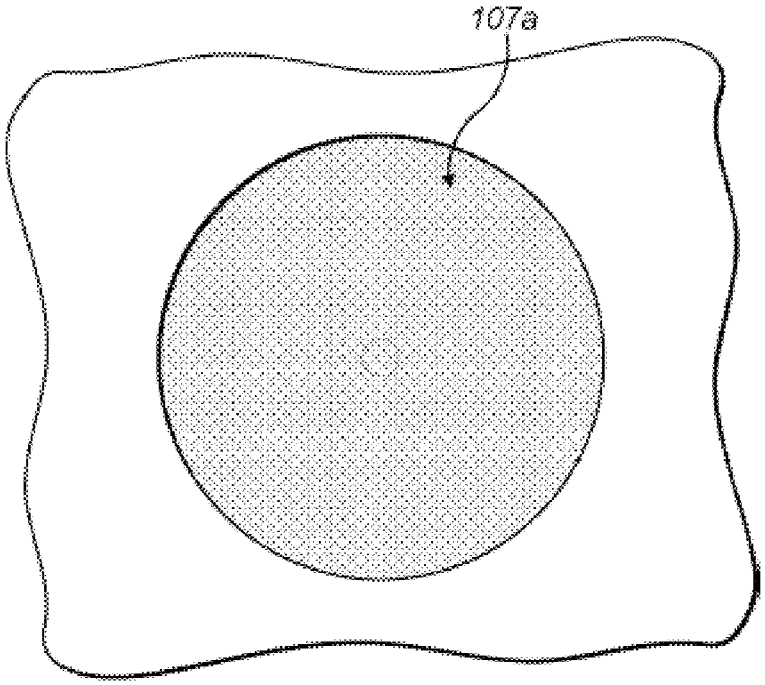

The operation of the nozzle plate 101 will now be described, with particular reference to FIGS. 3*a* and 3*b*. For convenience, the operation will be presented in terms of only one nozzle 103 of the plurality of similar nozzles which comprise the nozzle plate 101; however it will be understood that the principle of operation is the same for all of the nozzles.

Firstly, the nozzle plate 101 is primed for printing operations. Priming is performed by vibrating the nozzle plate 101, for example as described in WO-93/10910, in order to cause a portion of the stored printing liquid L to flow through the nozzle 103 and to be expelled from the outlet 103*a*. As the flow emerges, the printing liquid L spreads radially outwards of the outlet 103*a*, across the base portion 107*a* of the recess 107, and outwardly with respect to the shoulder portion 107*b*, so as to fill the recess 107. The printing liquid L is retained, or captured, in the recess 107 due to the containing-barrier formed by the shoulder portion 107*b*, and also the combined hydrophilic/hydrophobic effect of the coatings on the external surface 101*a* and portions of the recess 107, in addition to the adhesive forces acting at the interface between the printing liquid L and the wetted surfaces of the recess 107.

Alternatively, a separate priming liquid, different to the printing liquid L, may be used for priming. An example priming liquid is glycerol. Also, irrespective of the liquid type, the recess may be filled manually from its external, open side, rather than via the nozzle. In that case, any excess liquid left on the external surface 101*a* of the nozzle plate 101 after filling may be wiped away.

Priming waveforms which have found to be appropriate include exciting head resonances over ~60 kHz with a continuous sine-wave, or exciting several resonances together using a Sinc function. At moderate voltages these waveforms have the described effect of causing the printing liquid L to move out of the nozzle outlet 103*a*, laterally across the base portion 107*a* of the recess 107, until it reaches the edges of the recess 107, at which point the printing liquid L then pins at the sharp edges of the recess shoulder portion 107*b* in a new, stable equilibrium state. At lower frequencies, say ~20 kHz or less, instead of spreading sideways, the tendency is for the printing liquid L to jet straight out from the nozzle 103, or form a hemispherical bulge which projects upwards to form a drop, instead of moving laterally into the recess.

Once the recess 107 has been filled with the printing liquid L (or different priming liquid) and has achieved a stable condition, the printing process may be commenced, as follows.

The nozzle plate 101 is vibrated at an appropriate rate so that droplets of the printing liquid L may be ejected from the nozzle plate 101 onto, for example, a test substrate. Accordingly, as the nozzle plate 101 is activated, a bulk flow component F of the printing liquid L is passed through the nozzle 103 and out of the outlet 103*a*, where it encounters the layer of liquid in the recess 107. The vibration of the nozzle plate 101 is sufficiently great that the bulk flow F is driven through the liquid layer in the recess 107, such that droplets of the printing liquid L will be expelled from the nozzle plate 101 onto the test substrate.

As the printing process goes on, any portion or component of the thin layer of liquid, residing or retained in the recess 107, which is displaced by the bulk flow F as it emerges from the outlet 103*a*, is effectively replaced by some portion of the bulk flow F, such that there remains at all times a layer of liquid in the recess 107 through which the bulk flow F will pass. (In the case that the recess 107 was filled with a separate liquid during priming, e.g. glycerol, that liquid will tend to be displaced by the printing liquid L from the bulk flow F, so that eventually the recess 107 will be filled entirely, or almost entirely, by the printing liquid F). Accordingly, for as long as the nozzle plate 101 is being vibrated, droplets of the printing liquid L are continually ejected, through an ever-present layer of liquid, onto the test substrate. In this way, droplet ejection is substantially unaffected by meniscus- and edge-effects, which are normally associated with contact between the nozzle outlet and the flowing liquid, thereby providing a significant improvement in print stability and reliability.

It will be understood that the invention has been described in relation to its preferred embodiments and may be modified in many different ways without departing from the scope of the invention as defined by the accompanying claims.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A method for non-contact printing of liquids containing biological cells, the method comprising:

providing a print head including a perforate plate and an actuator, the perforate plate including at least one ejection element, the ejection element including an outlet configured to eject a bulk flow of a first liquid containing biological cells, and operating the actuator to vibrate the at least one ejection element in order to eject the bulk flow of the first liquid through a layer of a second liquid retained over the outlet, wherein a region of an external surface of the perforate plate extends laterally of a longitudinal axis of the at least one ejection element and is adapted to retain the layer of the second liquid over the outlet.

2. The method of claim 1, wherein the first liquid includes a reagent with any of DNA, proteins, cells and cell fragments.

3. The method of claim 1, wherein the second liquid is the same as the first liquid.

4. The method of claim 1, wherein the second liquid is different from the first liquid.

5. The method of claim 1, further including a step of priming the print head with a priming liquid prior to operating the actuator.

6. The method of claim 1, wherein the region of the external surface of the perforate plate comprises a recess in the external surface, the recess having a depth in the direction of the longitudinal axis and a lateral width in a direction normal to the longitudinal axis.

7. The method of claim 1, wherein the region of the external surface of the perforate plate comprises any of an hydrophilic or an hydrophobic coating.

8. The method of claim 1, wherein the perforate plate comprises a plurality of the ejection elements and respective regions of the external surface.

9. The method of claim 8, wherein the at least one ejection element comprises a nozzle.

10. A method for non-contact printing of liquids containing biological cells, the method comprising:

providing a print head including a membrane, the membrane including at least one ejection element, the ejection element including an outlet configured to eject a bulk flow of a first liquid containing biological cells, and operating an actuator to vibrate the at least one ejection element in order to eject the bulk flow of the first liquid through a layer of a second liquid retained over the outlet, wherein a region of an external surface of the membrane extends laterally of a longitudinal axis of the at least one ejection element and is adapted to retain the layer of the second liquid over the outlet.

11. The method of claim 10, wherein the region of the external surface of the member comprises a recess in the external surface, the recess having a depth in the direction of the longitudinal axis and a lateral width in a direction normal to the longitudinal axis.

12. The method of claim 11, wherein the recess has a ratio of lateral width to depth of between about 1 and 100.

13. The method of claim 11, wherein the recess has depth of about 3 to 50 microns.

14. The method of claim 10, wherein the first liquid includes a reagent with any of DNA, proteins, cells and cell fragments.

15. The method of claim 10, wherein the second liquid is the same as the first liquid.

16. The method of claim 10, wherein the second liquid is different from the first liquid.

17. The method of claim 10, further including a step of priming the print head with a priming liquid prior to operating the actuator.

18. The method of claim 10, wherein the region of the external surface of the member comprises a recess in the external surface, the recess having a depth in the direction of the longitudinal axis and a lateral width in a direction normal to the longitudinal axis.

19. A printing system for non-contact printing of liquids containing biological cells, the system comprising:

a reservoir of a first liquid containing biological cells, and a print head including a perforate plate or membrane and an actuator, the perforate plate or membrane including at least one ejection element, the ejection element including an outlet configured to eject a bulk flow of the first liquid, the actuator arranged to vibrate the at least one ejection element in order to eject the bulk flow, wherein a region of an external surface of the perforate plate or membrane extends laterally of a longitudinal axis of the at least one ejection element and is adapted to retain a layer of the second liquid over the outlet, such that in use the bulk flow of the first liquid is ejected through the layer of the second liquid.

20. The printing system of claim 19, wherein the first liquid includes a reagent with any of DNA, proteins, cells and cell fragments.

* * * * *